US009853399B2

(12) United States Patent
Kao et al.

(10) Patent No.: US 9,853,399 B2
(45) Date of Patent: Dec. 26, 2017

(54) ELECTRICAL PLUG CONNECTOR WITH SHIELDING AND GROUNDING FEATURES

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Chung-Fu Liao, New Taipei (TW); Mao-Sheng Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/944,174

(22) Filed: Nov. 17, 2015

(65) Prior Publication Data

US 2016/0149348 A1 May 26, 2016

(30) Foreign Application Priority Data

Nov. 21, 2014 (TW) ..... 103140595 A

(51) Int. Cl.

| | |
|---|---|
| ***H01R 13/648*** | (2006.01) |
| ***H01R 13/6585*** | (2011.01) |
| ***H01R 24/60*** | (2011.01) |
| *H01R 107/00* | (2006.01) |

(52) U.S. Cl.

CPC ..... *H01R 13/6585* (2013.01); *H01R 24/60* (2013.01); *H01R 2107/00* (2013.01)

(58) Field of Classification Search

CPC .. H01R 24/60; H01R 13/658; H01R 13/6581; H01R 13/6585; H01R 13/6275

USPC ..... 439/607.05, 676, 660

See application file for complete search history.

(56) References Cited

U.S. PATENT DOCUMENTS

| | | | | |
|---|---|---|---|---|
| 9,312,644 | B2 * | 4/2016 | Kao | H01R 13/6591 |
| 9,450,339 | B2 * | 9/2016 | Gao | H01R 13/6582 |
| 2015/0244111 | A1 * | 8/2015 | Ju | H01R 13/6585 439/607.05 |
| 2015/0244118 | A1 | 8/2015 | Lin | |
| 2016/0020560 | A1 * | 1/2016 | Ju | H01R 24/78 439/607.05 |

FOREIGN PATENT DOCUMENTS

| | | |
|---|---|---|
| CN | 203942104 U | 11/2014 |
| TW | 200945700 A1 | 11/2009 |
| TW | M486881 | 9/2014 |

* cited by examiner

*Primary Examiner* — Hae Moon Hyeon
(74) *Attorney, Agent, or Firm* — Winston Hsu

(57) ABSTRACT

An electrical plug connector includes a plug metal shell, an insulation housing bracket, a plug grounding contact, and a grounding member. The plug metal shell encloses a tongue portion of the insulation housing bracket. The plug grounding contact is held inside the insulation housing bracket. The grounding member is disposed between the plug metal shell and the plug grounding contact and spaced from the first side of the insulation housing bracket. A connecting portion is selectively disposed on the grounding member or on the plug grounding contact. The connecting portion mechanically contacts to the grounding member and the plug grounding contact such that the grounding member is electrically connected to the plug grounding contact.

24 Claims, 11 Drawing Sheets

ELECTRICAL PLUG CONNECTOR WITH SHIELDING AND GROUNDING FEATURES

BACKGROUND OF THE INVENTION

1. Field of the Invention

The present invention relates to an electrical plug connector, and more particularly, to an electrical plug connector adapted for a Universal Serial Bus interface and capable of reducing high frequency interferences and electromagnetic interferences.

2. Description of the Prior Art

With the development of computer and peripheral equipment industry, a Universal Serial Bus (USB) interface has become one of important interfaces for communication and data transmission between computers and peripheral equipment. As technology advances, high speed transmission is a trend, and there is a need to develop an electrical connector with high speed transmission. Furthermore, with the trend of an electrical device with thin thickness, the electrical connector with thin thickness is required. The electrical connector with high speed transmission and thin thinness results in high frequency interferences (HFIs) and electromagnetic interferences (EMIs) among contacts of the electrical connector or between the coupled electrical connectors. Thus, it impacts on performance of high frequency transmission or high speed transmission between a USB electrical plug connector and a USB electrical receptacle connector and may impact on normal performance of an electrical device to which the aforesaid connectors are coupled, such as a Bluetooth device, a mobile phone, a laptop, a tablet, or a hard disc drive. Therefore, it has become an important topic to design a new USB electrical plug connector with thin thinness, high speed transmission, and reliability as well as capability of reducing HFIs and EMIs due to thin thickness and high speed transmission of the electrical connectors.

SUMMARY OF THE INVENTION

The present invention provides an electrical plug connector, and more particularly, to an electrical plug connector adapted for a Universal Serial Bus interface and capable of reducing high frequency interferences and electromagnetic interferences for solving above drawbacks.

According to the claimed invention, an electrical plug connector includes a plug metal shell, an insulation housing bracket, a first plug grounding contact and a first grounding member. The insulation housing bracket is combined with the plug metal shell and has a first side. The first plug grounding contact is held inside the insulation housing bracket. The first grounding member is disposed between the plug metal shell and the first plug grounding contact and spaced from the first side of the insulation housing bracket. The first grounding member mechanically contacts with the first plug grounding contact, such that the first grounding member is electrically connected to the first plug grounding contact.

According to the claimed invention, the first grounding member includes a first connecting structure protruding from the first grounding member and contacting with the first plug grounding contact, such that the first grounding member is electrically connected to the first plug grounding contact.

According to the claimed invention, the first connecting structure is a protrusion portion or a spring arm, and the first connecting structure and the first grounding member are integrally formed.

According to the claimed invention, the first plug grounding contact includes a first connecting structure protruding from the first grounding contact and contacting with the first grounding member, such the first grounding member is electrically connected to the first plug grounding contact.

According to the claimed invention, the first connecting structure is a contact bending structure, and the first connecting structure and the first plug grounding contact are integrally formed.

According to the claimed invention, the insulation housing bracket has a second side opposite to the first side, and the electrical plug connector further includes a second plug grounding contact and a second grounding member. The second plug grounding contact is held inside the insulation housing bracket and corresponding to the first plug grounding contact. The second grounding member is disposed between the plug metal shell and the second plug grounding contact and spaced from the second side of the insulation housing bracket. The second grounding member mechanically contacts with the second plug grounding contact, such that the second grounding member is electrically connected to the second plug grounding contact.

According to the claimed invention, the second grounding member includes a second connecting structure protruding from the second grounding member and contacting with the second plug grounding contact, such that the second grounding member is electrically connected to the second plug grounding contact. The second connecting structure is a protrusion portion or a spring arm, and the second connecting structure and the second grounding member are integrally formed.

According to the claimed invention, the second plug grounding contact includes a second connecting structure protruding from the second grounding contact and contacting with the second grounding member, such the second grounding member is electrically connected to the second plug grounding contact. The second connecting structure is a contact bending structure, and the second connecting structure and the second plug grounding contact are integrally formed.

According to the claimed invention, an accommodating space is enclosed by the plug metal shell, and the electrical plug connector further includes an insulation housing disposed inside the accommodating space. An internal socketing space is enclosed by the insulation housing and for accommodating the first plug grounding contact and the second plug grounding contact.

According to the claimed invention, the first grounding member further includes a first grounding body and a first abutting portion. The first grounding body is installed on the insulation housing. The first abutting portion protrudes from the first grounding body. The first abutting portion abuts against the plug metal shell, such that the first grounding body is electrically connected to the plug metal shell.

According to the claimed invention, the second grounding member further includes a second grounding body and a second abutting portion. The second grounding body is installed on a side of the insulation housing and opposite to the first grounding body. The second abutting portion protrudes from the second grounding body. The second abutting portion abuts against the plug metal shell, such that the second grounding body is electrically connected to the plug metal shell.

According to the claimed invention, the first grounding member further includes a first resilient portion extending from an end of the first grounding body and stretching into the internal socketing space. The second grounding member further includes a second resilient portion extending from an end of the second grounding body and stretching into the internal socketing space.

According to the claimed invention, the first grounding member further includes a first mounting leg protruding from the first grounding body and embedding into the insulation housing. The second grounding member further includes a second mounting leg protruding from the second grounding body and embedding into the insulation housing.

According to the claimed invention, the electrical plug connector further includes a first signal contact set, a second signal contact set and a shielding member. The first signal contact set is arranged alongside the first plug grounding contact. The second signal contact set is arranged alongside the second plug grounding contact. The shielding member is disposed between the first signal contact set and the second signal contact set. The shielding member is for shielding the first signal contact set and the second signal contact set.

According to the claimed invention, the insulation housing bracket includes a first insulator and a second insulator. The second insulator is detachably assembled on the first insulator, and the first insulator and the second insulator clamp the shielding member cooperatively.

According to the claimed invention, the first insulator includes a first protruding pillar and a first engaging hole formed thereon. The second insulator includes a second protruding pillar and a second engaging hole formed thereon. A first through hole and a second through hole are formed on the shielding member. The first protruding pillar engages with the second engaging hole via the first through hole, and the second protruding pillar engages with the first engaging hole via the second through hole.

According to the claimed invention, the shielding member includes a shielding body, a resilient hook and a grounding portion. The resilient hook extends from the shielding body and is for hooking an electrical receptacle connector. The grounding portion extends from a side of the shielding body and is opposite to the resilient hook. The grounding portion is coupled to a circuit board.

According to the claimed invention, an electrical plug connector includes a plug metal shell, a first terminal module, a second terminal module, an insulation housing and a first grounding member. An accommodating space is enclosed by the plug metal shell. The first terminal module includes a first insulator, a first signal contact and two first plug grounding contacts. The first signal contact set is held inside the first insulator. The two first plug grounding contacts are held inside the first insulator and arranged alongside the first signal contact set. The two first plug grounding contacts are disposed on two opposite sides of the first signal contact set respectively. The second terminal module includes a second insulator, a second signal contact set and two second grounding contacts. The second insulator is assembled with the first insulator to form an insulation housing bracket. The second signal contact set is held inside the second insulator. The two second grounding contacts are held inside the second insulator and arranged alongside the second signal contact set. The two second grounding contacts are disposed on two opposite sides of the second signal contact set respectively. The insulation housing is disposed inside the accommodating space. An internal socketing space is enclosed by the insulation housing and for accommodating the first plug grounding contact and the second plug grounding contact. The first grounding member is disposed between the plug metal shell and the first plug grounding contact, and spaced from the first side of the insulation housing bracket. The first grounding member mechanically contacts with the first plug grounding contact, such that the first grounding member is electrically connected to the first plug grounding contact.

According to the claimed invention, each of the first signal contact set and the second signal contact set includes at least two pairs of differential signal contacts. The differential signal contacts of the first signal contact set is symmetric to the differential signal contacts of the second signal contact set by rotational of 180 degrees along a front-back direction of the electrical plug connector.

In contrast to the prior art, the present invention utilizes the first connecting structure and the first abutting portion for electrically connecting the plug metal shell, the first grounding member, and the first plug grounding contact. The present invention further utilizes the second connecting structure and second abutting portion for electrically connecting the plug metal shell, the second grounding member, and the second plug grounding contact. In such a way, electromagnetic noises and electromagnetic interferences can be reduced when the electrical plug connector transmits high frequency signals or high speed signals, such that performance of high frequency transmission or high speed transmission of the electrical plug connector is improved. Furthermore, the present invention further utilizes the shielding member disposed between the first signal contact set and the second signal contact set for shielding the first signal contact set and the second signal contact set and for preventing interferences and crosstalk therebetween.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," etc., is used with reference to the orientation of the Figure (s) being described. The components of the present invention can be positioned in a number of different orientations. As such, the directional terminology is used for purposes of illustration and is in no way limiting. Accordingly, the drawings and descriptions will be regarded as illustrative in nature and not as restrictive.

Figure 1:
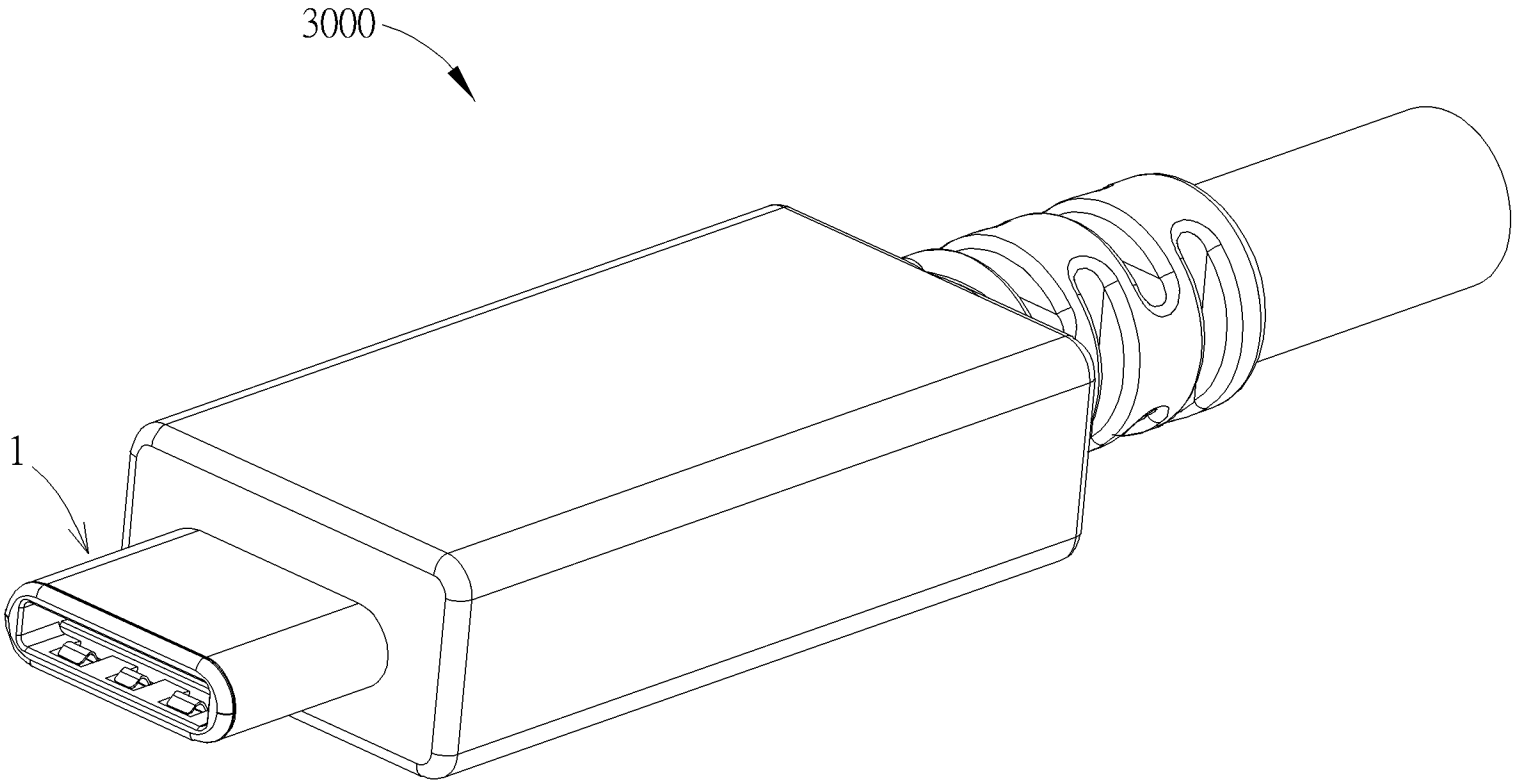
FIG. 1 is a schematic diagram of an electrical plug connector according to a first embodiment of the present invention.
Figure 2:
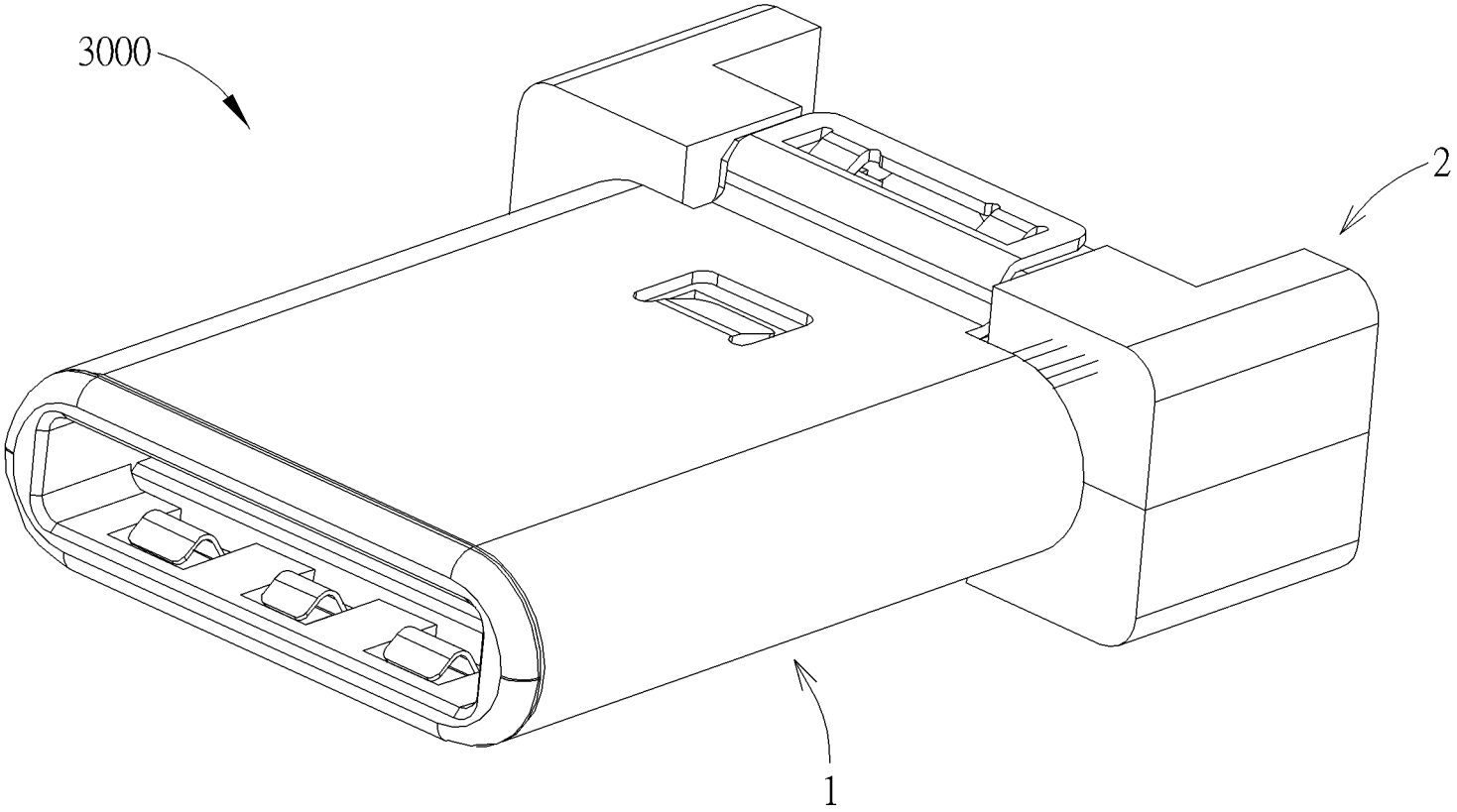
FIG. 2 is a diagram of the electrical plug connector according the first embodiment of the present invention.
Figure 3:
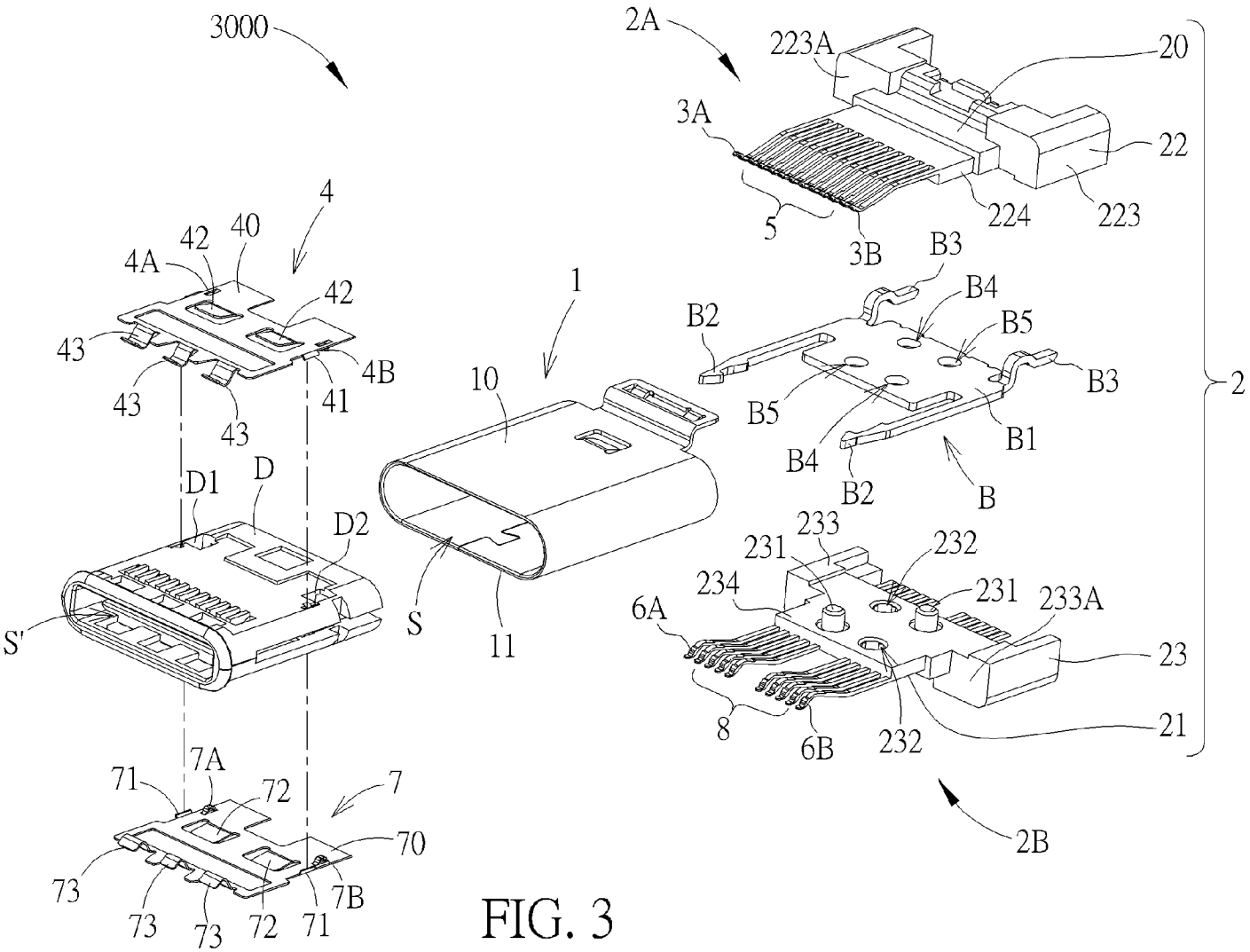
FIG. 3 and FIG. 4 are exploded diagrams of the electrical plug connector in different views according to the first embodiment of the present invention.
Figure 4:
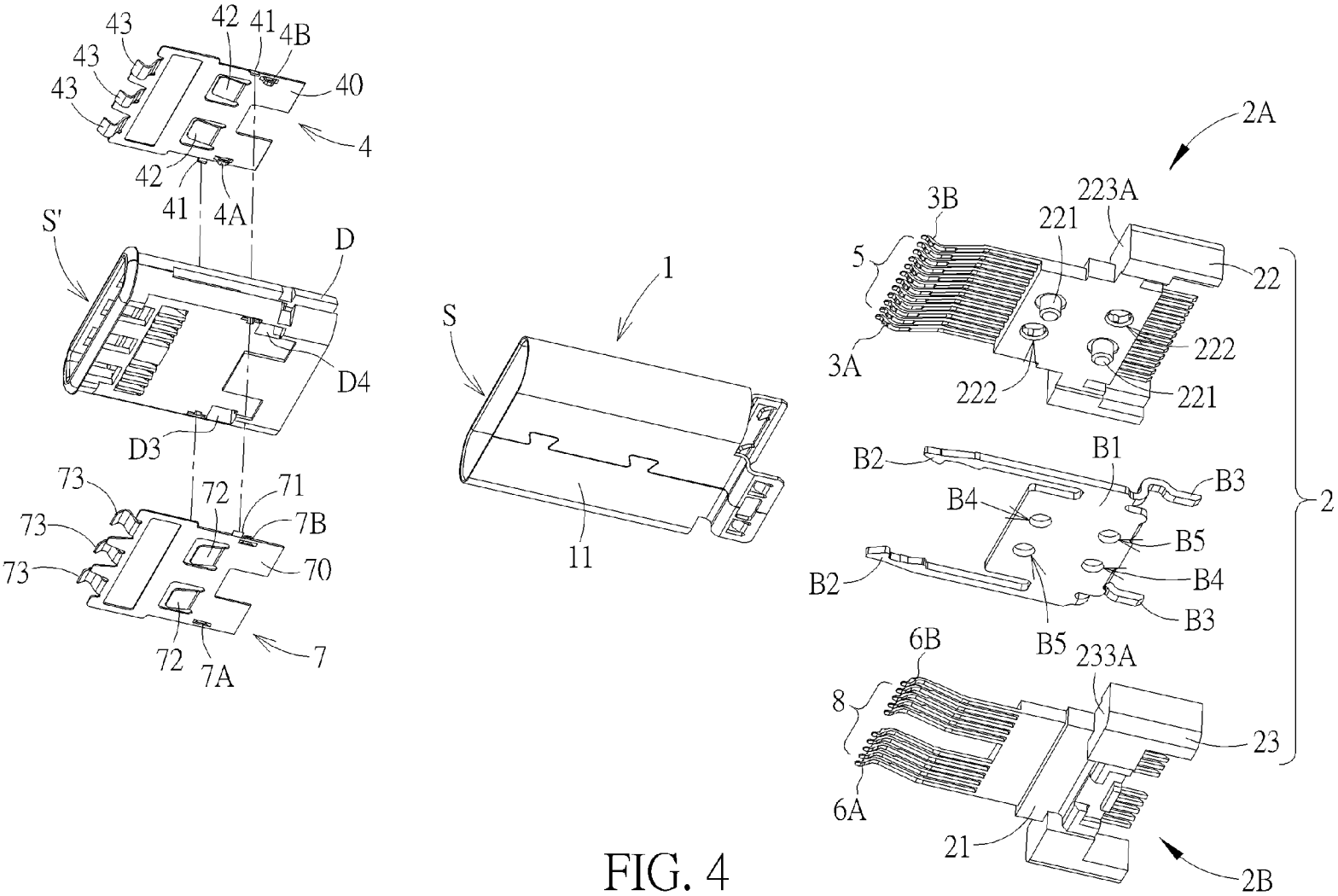

Please refer to FIG. 1 to FIG. 4. FIG. 1 is a schematic diagram of an electrical plug connector 3000 according to a first embodiment of the present invention. FIG. 2 is a diagram of the electrical plug connector 3000 according the first embodiment of the present invention. FIG. 3 and FIG. 4 are exploded diagrams of the electrical plug connector 3000 in different views according to the first embodiment of the present invention. As shown in FIG. 1 to FIG. 4, the electrical plug connector 3000 includes a plug metal shell 1, a first terminal module 2A, a second terminal module 2B, a first grounding member 4, a second grounding member 7, and a shielding member B. The first terminal module 2A includes a first insulator 22, two first plug grounding contacts 3A, 3B and a first signal contact set 5. The two first plug grounding contacts 3A, 3B and the first signal contact set 5 are held inside the first insulator 22. The first insulator 22 includes a first base portion 223 and a first tongue portion 224. Fixing portions of the two first plug grounding contacts 3A, 3B and the first signal contact set 5 are held inside the first insulator 22. Resilient portions of the two first plug grounding contacts 3A, 3B and the first signal contact set 5 extend forwardly from the fixing portions thereof along a front-back direction of the electrical plug connector 3000, and end portions of the two first plug grounding contacts 3A, 3B and the first signal contact set 5 extend backwardly from the fixing portions thereof along the front-back direction of the electrical plug connector 3000.

The second terminal module 2B includes a second insulator 23, two second plug grounding contacts 6A, 6B and a second signal contact set 8. The two second plug grounding contacts 6A, 6B and the second signal contact set 8 are held inside the second insulator 23. The second insulator 23 includes a second base portion 233 and a second tongue portion 234. Fixing portions of the two second plug grounding contacts 6A, 6B and the second signal contact set 8 are held inside the second insulator 23. Resilient portions of the two second plug grounding contacts 6A, 6B and the second signal contact set 8 extend forwardly from the fixing portions along the front-back direction of the electrical plug connector 3000, and end portions of the two second plug grounding contacts 6A, 6B and the second signal contact set 8 extend backwardly from the fixing portions along the front-back direction of the electrical plug connector 3000. The first plug grounding contacts 3A, 3B and the first signal contact set 5 can be held inside the first insulator 22 in an insert-molding manner or in an assembling manner, and the second grounding contacts 6A, 6B and the second signal contact set 8 can be held inside the second insulator 23 in an insert-molding manner or in an assembling manner respectively. Furthermore, the second insulator 23 is detachably assembled on the first insulator 22, and the first insulator 22 and the second insulator 23 clamp the shielding member B cooperatively. The shielding member B is disposed between the first insulator 22 and the second insulator 23. The first insulator 22 is assembled with the second insulator 23 to form an insulation housing bracket 2. The insulation housing bracket 2 has a first side 20 and a second side 21 opposite to the first side 20, i.e., the first side 20 is located on the first tongue portion 224 of the first insulator 22, and the second side 21 is located on the second tongue portion 234 of the second insulator 23.

Figure 5:
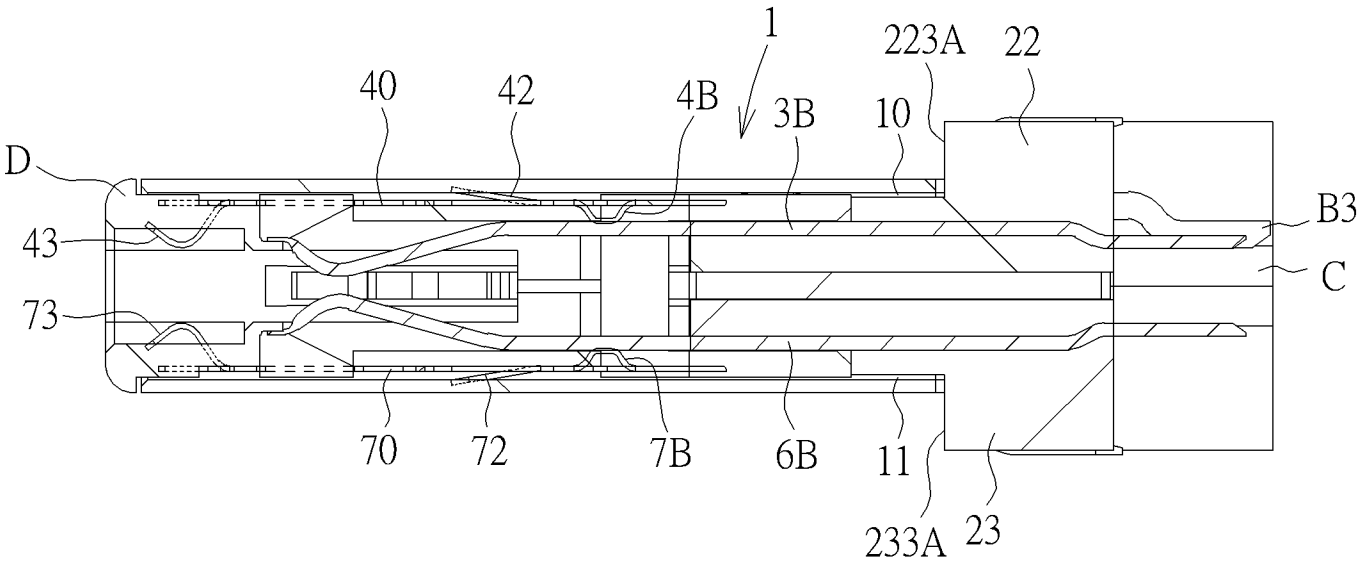
FIG. 5 is a sectional diagram of the electrical plug connector according to the first embodiment of the present invention.
Figure 6:
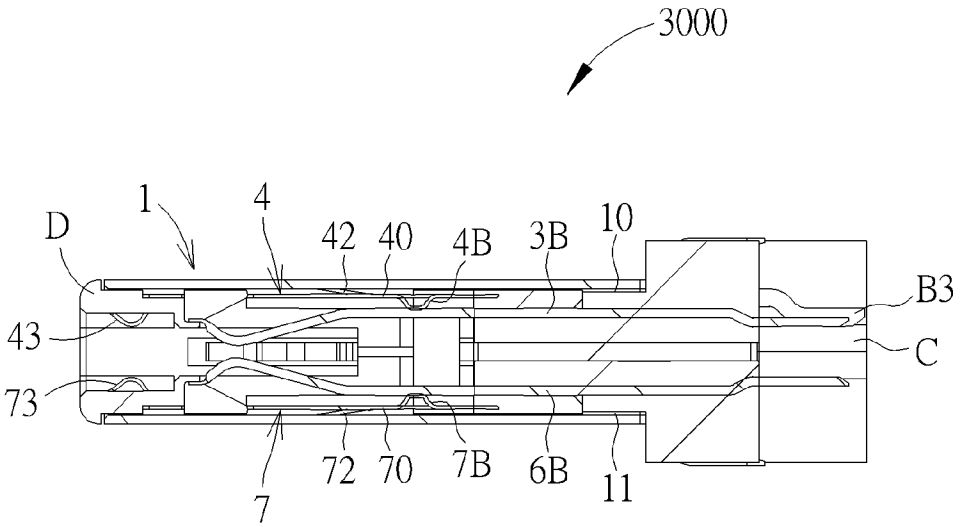
FIG. 6 and FIG. 7 are sectional diagrams of the electrical plug connector and an electrical receptacle connector in different views according to the first embodiment of the present invention.
Figure 6:
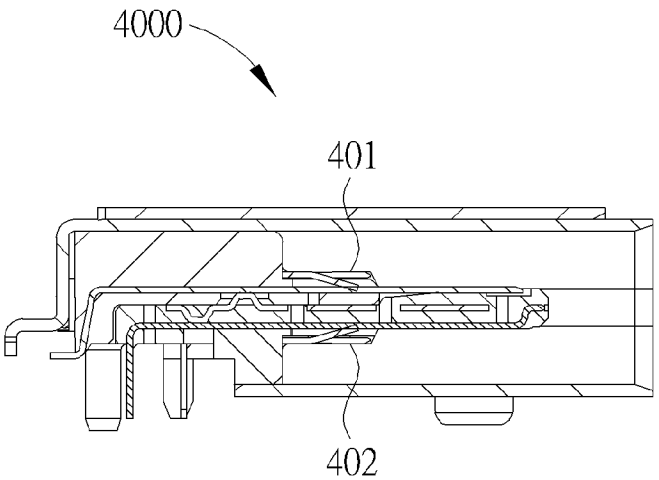
Figure 7:
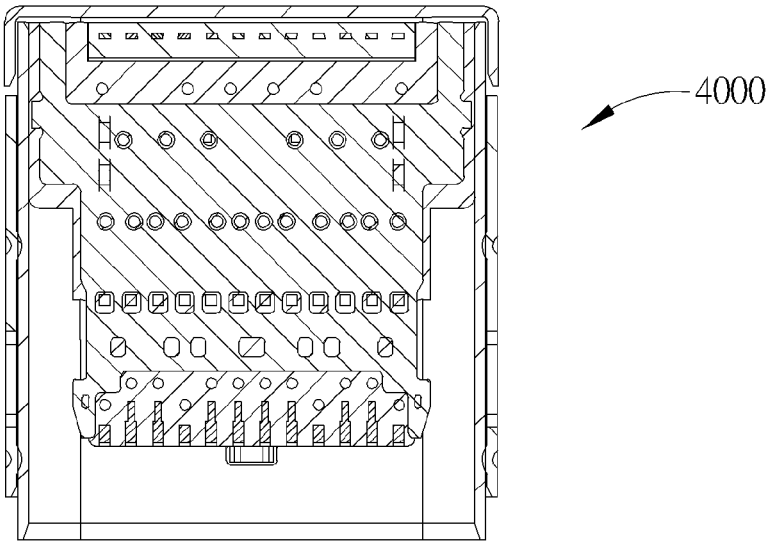
Figure 7:
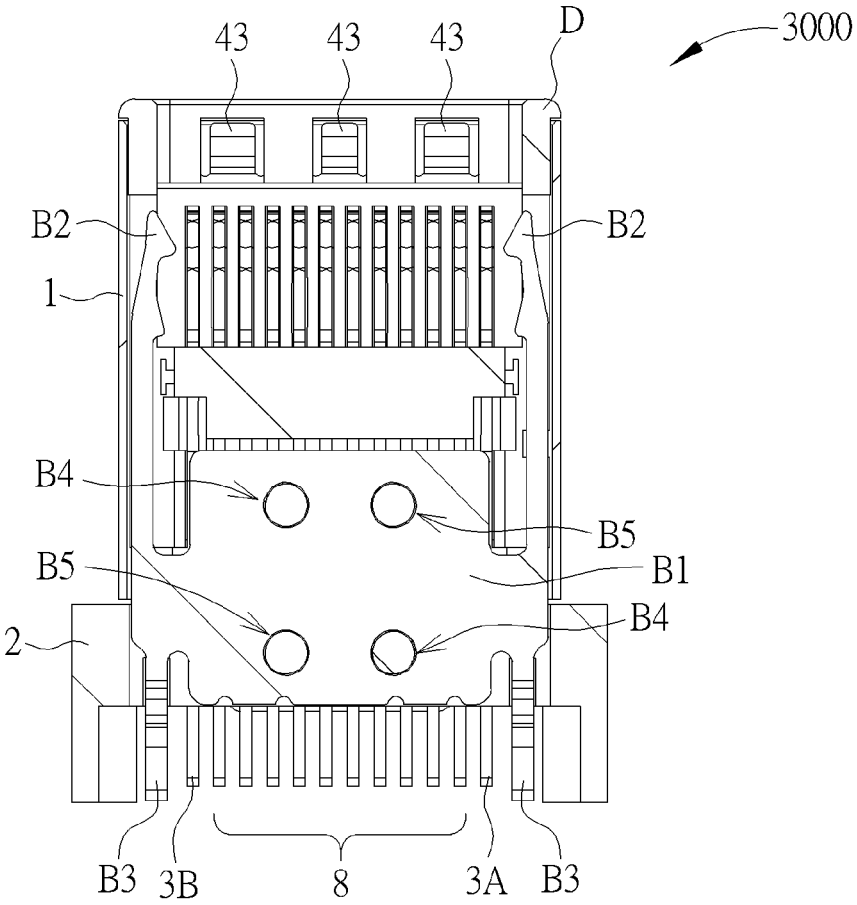

Please refer to FIG. 3 to FIG. 7. FIG. 5 is a sectional diagram of the electrical plug connector 3000 according to the first embodiment of the present invention. FIG. 6 and FIG. 7 are sectional diagrams of the electrical plug connector 3000 and an electrical receptacle connector 4000 in different views according to the first embodiment of the present invention. As shown in FIG. 3 to FIG. 7, the electrical plug connector 3000 further includes an insulation housing D. An internal socketing space S' is enclosed by the insulation housing D and for accommodating the first plug grounding contacts 3A, 3B, the first signal contact set 5, the second plug grounding contacts 6A, 6B, and the second signal contact set 8. The resilient portions of the first plug grounding contacts 3A, 3B, the first signal contact set 5, the second plug grounding contacts 6A, 6B, and the second signal contact set 8 stretch into the internal socket space S' from a rear side of the insulation housing D along the front-back direction of the electrical plug connector 3000. The first tongue portion 224 and the second tongue portion 234 are accommodated inside an accommodation space (not shown in figures) formed on the rear side of the insulation housing D. Furthermore, an accommodating space S is enclosed by the plug metal shell 1. The insulation housing D, the first plug grounding contacts 3A, 3B, the first signal contact set 5, the second plug grounding contacts 6A, 6B, the second signal contact set 8, the first tongue portion 224 and the second tongue portion 234 are disposed in the accommodating space S. The first terminal module 2A and the second terminal module 2B are combined with the plug metal shell 1. A rear side of the plug metal shell 1 abuts against a first abutting surface 223A of the first base portion 223 of the first insulator 22 and a second abutting surface 233A of the second base portion 233 of the second insulator 23.

In addition, the first grounding member 4 includes a first grounding body 40 and a pair of first mounting legs 41, and the second grounding member 7 includes a second grounding body 70 and a pair of second mounting legs 71. The first grounding body 40 of the first grounding member 4 is installed on a top side of the insulation housing D, i.e., the top side is the same as the first side 20 of the insulation housing bracket 2. In other words, the first grounding member 4 is installed on the top side of the insulation housing D, located between the plug metal shell 1 and the first plug grounding contacts 3A, 3B and spaced from the first side 20 of the first tongue portion 224 of the first insulator 22 of the insulation housing bracket 2. The first mounting leg 41 protrudes from the first grounding body 40. When the first grounding member 4 is installed on the insulation housing D, the first mounting leg 41 embeds into the insulation housing D for mounting the first grounding member 40 onto the insulation housing D. The second grounding body 70 of the second grounding member 7 is installed on a bottom side of the insulation housing D and away from the first grounding member 40, i.e., the bottom side is the same as the second side 21 of the insulation housing bracket 2. In other words, the second grounding member 7 is installed on the bottom side of the insulation housing D, located between the plug metal shell 1 and the second plug grounding contacts 6A, 6B and spaced from the second side 21 of the second tongue portion 234 of the second insulator 23 of the insulation housing bracket 2. The second mounting leg 71 protrudes from the second grounding body 70. When the second grounding member 7 is installed on the insulation housing D, the second mounting leg 71 embeds into the insulation housing D for mounting the second grounding body 70 onto the insulation housing D. The first grounding member 4 further includes two first connecting structures 4A, 4B. The first connecting structures 4A, 4B are formed on the first grounding body 40 and protrude from the first grounding body 40 of the first grounding member 4 toward the first plug grounding contacts 3A, 3B. The second grounding member 7 further includes two second connecting structures 7A, 7B. The second connecting structures 7A, 7B are formed on the second grounding body 70 and protrude from the second grounding body 70 of the second grounding member 7 toward the second plug grounding contacts 6A, 6B.

It should be noted that, in this embodiment, the first plug grounding contacts 3A, 3B are located on two opposite sides of the first signal contact set 5 and the first connecting structures 4A, 4B are disposed on lateral sides of the first grounding body 40 of the first grounding member 4 and located corresponding to the first plug grounding contacts 3A and 3B, i.e., the first connecting structures 4A, 4B are configured at locations corresponding to the first plug grounding contacts 3A, 3B. Therefore, the first connecting structures 4A, 4B can mechanically contact with the first grounding member 4 and the first plug grounding contacts 3A, 3B via the internal socketing space S' enclosed by the insulation housing D when the first grounding member 4 is installed on the insulation housing D. In this embodiment, the first connecting structures 4A, 4B can be protrusion portions connected to the first grounding body 40 of the first grounding member 4. In other words, when the first grounding member 4 is installed on the insulation housing D, the protrusion portions (i.e., the first connecting structures 4A, 4B) can abut against the first plug grounding contacts 3A, 3B, such that the protrusion portions are connected to the first grounding member 4 and the first plug grounding contacts 3A, 3B. In this embodiment, two first passing holes D1, D2 are formed on the insulation housing D and located corresponding to the first connecting structures 4A, 4B and the first plug grounding contacts 3A, 3B. Accordingly, the first connecting structures 4A, 4B are able to contact with the first grounding member 4 via the passing holes D1, D2.

Furthermore, the first grounding member 4 further includes a first abutting portion 42 protruding from the first grounding body 40. The first abutting portion 42 is for abutting against the plug metal shell 1, such that the first grounding body 40 is electrically connected to the plug metal shell 1.

Since the plug metal shell 1 and the first grounding member 4 are made of metal material, the first grounding member 4 is electrically connected to the first plug grounding contacts 3A, 3B, such that electromagnetic noises accumulated on the plug metal shell 1 is conducted to the first plug grounding contacts 3A, 3B when the first grounding member 4 shields signal contact sets (i.e., the first signal contact set 5 and the second signal contact set 8) and the plug metal shell 1 of the electrical plug connector 3000. Accordingly, the electromagnetic noises are grounded to be eliminated for reducing electromagnetic interferences of the electrical plug connector 3000 during high frequency transmission, which improves performance of high frequency transmission or high speed transmission of the electrical plug connector 3000. In practical applications, the first connecting structures 4A, 4B can be resilient members protruding from the first grounding member 4 or integrally formed with the first grounding member 4, but the present invention is not limited to thereto.

Similarly, in this embodiment, the second plug grounding contacts 6A, 6B are located on two opposite sides of the second signal contact set 8, and the second connecting structures 7A, 7B are disposed on lateral sides of the second grounding body 70 of the second grounding member 7 and corresponding to the second plug grounding contacts 6A, 6B. In other words, the second connecting structures 7A, 7B are configured corresponding to the second plug grounding contacts 6A, 6B. Therefore, when the second grounding member 7 is installed on the insulation housing D, the second connecting structures 7A, 7B can mechanically contact with the second grounding member 7 and the second plug grounding contacts 6A, 6B via the internal socketing space S' of the insulation housing D. In this embodiment, the second connecting structures 7A, 7B are protrusion portions connected to the second grounding body 70 of the second grounding member 7. In other words, when the second grounding member 7 is installed on the insulation housing D, the protrusion portions (i.e., the second connecting structures 7A, 7B) can abut against the second plug grounding contacts 6A, 6B, such that the protrusion portions is able to mechanically contact with the second grounding member 7 and the second plug grounding contacts 6A, 6B. In this embodiment, two second passing holes D3, D4 are formed on the insulation housing D and located corresponding to the second connecting structures 7A, 7B and to the second plug grounding contacts 6A, 6B, such that the second connecting structures 7A, 7B is able to contact with the second grounding member 7 via the second passing holes D3, D4.

In addition, the second grounding member 7 includes a second abutting portion 72 protruding from the second grounding body 70. The second abutting portion 72 is for abutting against the plug metal shell 1, such that the second grounding body 70 is electrically connected to the plug metal shell 1. In this embodiment, each of the first abutting portion 42 and the second abutting portion 72 can respectively be a spring arm, but the present invention is not limited thereto.

Since the plug metal shell 1 and the second grounding member 7 are made of metal material, the second grounding member 7 is electrically connected to the second plug grounding contacts 6A, 6B, such that electromagnetic noises accumulated on the plug metal shell 1 is conducted to the second plug grounding contacts 6A, 6B via the second grounding member 7 when the second grounding member 7 shields the signal contact sets (i.e., the first signal contact set 5 and the second signal contact set 8) and the plug metal shell 1. The electromagnetic noises on plug metal shell 1 are grounded to be eliminated for reducing electromagnetic interferences of the electrical plug connector 3000 during high frequency transmission, which improves performance of high frequency transmission or high speed transmission of the electrical plug connector 3000. In practical applications, the second connecting structures 7A, 7B can be resilient members protruding from the second grounding member 7 or integrally formed with the second grounding member 7, but the present invention is not limited to thereto.

In summary, the first abutting portion 42 can electrically conduct the electromagnetic noises accumulated on the plug metal shell 1 to the first plug grounding contacts 3A, 3B via the first grounding body 40 when the signal contact sets (i.e. the first signal contact set 5 and the second signal contact set 8) of the electrical plug connector 3000 are in high frequency transmission. The second abutting portion 72 can also conduct the electromagnetic noises accumulated on the plug metal shell 1 to the second plug grounding contacts 6A, 6B via the second grounding body 70 when the signal contact sets (i.e. the first signal contact set 5 and the second signal contact set 8) of the electrical plug connector 3000 are in high frequency transmission. In such a way, the electromagnetic noises on the plug metal shell 1 are grounded to be eliminated by the first plug grounding contacts 3A, 3B or by the second plug grounding contacts 6A, 6B, which improves performance of high frequency transmission or high speed transmission of the electrical plug connector 3000.

Furthermore, the first grounding member 4 further includes three first resilient portions 43 protruding from a side of the first grounding body 40. The second grounding member 7 further includes three second resilient portions 73 protruding from a side of the second grounding body 70 and stretching into the internal socketing space S', respectively. When the first grounding member 4 is installed on the insulation housing D, the first resilient portion 43 stretches into the internal socketing space S'. Accordingly, the first resilient portion 43 can resiliently abut against a third metal shielding member 401 covering an outer side of an insulation housing bracket of the electrical receptacle connector 4000 when the electrical plug connector 3000 is mated with the electrical receptacle connector 4000. In such a manner, the third metal shielding member 401 located on the outer side of the insulation housing bracket of the electrical receptacle connector 4000, the first grounding member 4, and the first plug grounding contacts 3A, 3B are electrically connected. Similarly, when the second grounding member 7 is installed on the insulation housing D, the second resilient portion 73 stretches into the internal socketing space S'. Accordingly, the second resilient portion 73 can resiliently abut against a fourth metal shielding member 402 covering an outer side of the insulation housing bracket of the electrical receptacle connector 4000 when the electrical plug connector 3000 is connected to the electrical receptacle connector 4000. In such a manner, the fourth metal shielding member 402 located on the outer side of the insulation housing bracket of the electrical receptacle connector 4000, the second grounding member 7, and the second plug grounding contacts 6A, 6B are electrically connected. The third metal shielding member 401 and the fourth metal shielding member 402 can be electrically connected to a receptacle metal shell of the electrical receptacle connector 4000, respectively. In such a way, a shield is formed between the signal contact sets of the electrical plug connector 3000 and of the electrical receptacle connector 4000, so as to prevent electromagnetic interferences and crosstalk.

As shown in FIG. 2 to FIG. 5, the first grounding member 4 is disposed between the plug metal shell 1 and the insulation housing D, i.e., the first grounding member 4 is located between a top wall 10 of the plug metal shell 1 and the insulation housing D. The first connecting structures 4A, 4B are disposed on the first grounding member 4. The second grounding member 7 is disposed between the plug metal shell 1 and the insulation housing D, i.e., the second grounding member 7 is located between a bottom wall 11 of the plug metal shell 1 and the insulation housing D. The second connecting structures 7A, 7B are disposed on the first grounding member 7. It should be noted that the numbers of the first plug grounding contacts 3A, 3B, the first connecting structures 4A, 4B, the second plug grounding contacts 6A, 6B and the second connecting structures 7A, 7B of the present invention are not limited to those illustrated in figures in this embodiment. For example, the electrical plug connector 3000 can only include one first plug grounding contact, one first connecting structure, one second grounding contact and one second connecting structure. Structures with the aforesaid designs are within the scope of the present invention.

As shown in FIG. 3 to FIG. 7, the first signal contact set 5 is arranged alongside the first plug grounding contacts 3A, 3B. The first plug grounding contacts 3A, 3B are located on two opposite sides of the first signal contact set 5. Pin assignment from left to right of the first signal contact set 5 and the first plug grounding contacts 3A, 3B is the first plug grounding contact (GND) 3A, a pair of first differential signal contacts (RX2+, RX2−), a first power contact (VBUS), a first auxiliary signal contact (SBU1), a pair of second differential signal contacts (D−, D+), a positioning contact (CC), a power contact (VBUS), a pair of third differential signal contacts (TX1−, TX1+) and the first plug grounding contact (GDN) 3B. The second signal contact set 8 is arranged alongside the first plug grounding contacts 6A, 6B. The second plug grounding contacts 6A, 6B are located on two opposite sides of the second signal contact set 8. Pin assignment from left to right of the second signal contact set 8 and the first plug grounding contacts 6A, 6B is the second plug grounding contact (GND) 6A, a pair of fourth differential signal contacts (TX2+, TX2−), a second power contact (VBUS), an auxiliary power contact (VCONN), a second auxiliary signal contact (SBU2), a third power contact (VBUS), a pair of fifth differential signal contacts (RX1−, RX1+), and the second plug grounding contact (GDN) 6B. There is no signal contact (i.e., a pair of differential signal contacts (D−, D+)) disposed between the second auxiliary power contact (VCONN) and the second auxiliary signal contact (SBU2), such that the second auxiliary power contact (VCONN) is spaced from the second auxiliary signal contact set (SBU2). In other words, the first signal contact set 5 and the first plug grounding contacts 3A, 3B are arranged alongside on the first side 20 of the insulation housing bracket 2, and the second signal contact set 8 and the second plug grounding contacts 6A, 6B are arranged alongside on the second side 21 of the insulation housing bracket 2. Furthermore, in this embodiment, the electrical plug connector 3000 is a Universal Serial Bus Type-C (USB Type-C) electrical plug connector. The first differential signal contacts (RX2+, RX2−), the third differential signal contacts (TX1−, TX1+), the fourth differential signal contacts (TX2+, TX2−), and the fifth differential signal contacts (RX1−, RX1+) are able to perform signal transmission satisfying specification of USB 3.0 or USB 3.1. The second differential signal contacts (D−, D+) is able to perform signal transmission satisfying specification of USB 2.0.

It should be noticed that, in this embodiment, the arrangement and the pin assignment of the first plug grounding contacts 3A, 3B as well as the first differential signal contacts (RX2+, RX2−) and the third differential signal contacts (TX1−, TX1+) of the first signal contact set 5 is identical to the arrangement and the pin assignment of the second plug grounding contacts 6A, 6B as well as the fourth differential signal contacts (TX2+, TX2−) and the fifth differential signal contacts (RX1−, RX1+) of the second signal contact set 8 after rotation of 180 degrees along the front-back direction of the electrical plug connector 3000. In other words, each of the first signal contact set 5 and the second signal contact set 8 includes at least two pairs of differential signal contact sets. The at least two pairs of the differential signal contact sets of the first signal contact set 5 is symmetric to the at least two pairs of the differential signal contact sets of the second signal contact set 8 by rotation of 180 degrees along the front-back direction of the electrical plug connector. Additionally, the first differential signal contacts (RX2+, RX2−) can be compatible and communicated with the fifth differential signal contact sets (RX1+, RX1−), and the third differential signal contacts (TX1+, TX1−) can be compatible and communicated with the fourth differential signal contacts (TX2+, TX2−).

Therefore, no matter when the electrical plug connector 3000 is mated with the electrical receptacle connector 4000 with normal orientation (i.e., 0 degree) or when the electrical plug connector 3000 is mated with the electrical receptacle connector 4000 with reverse orientation (i.e., 180 degrees), the electrical plug connector 3000 is able to normally transmit signals with the corresponding electrical receptacle connector 4000. Furthermore, it should be noted that each of the first grounding member 4 and the second grounding member 7 can be respectively an Electro Magnetic Interference (EMI) shielding spring members of the USB Type-C electrical plug connector. The shielding member B can be a shielding plate of the USB Type-C electrical plug connector. The EMI shielding spring members (i.e., the first grounding member 4 and the second grounding member 7) are disposed outside of the top side and the bottom side of the insulation housing bracket 2 of the USB Type-C electrical plug connector (i.e., the electrical plug connector 3000). The shielding plate (i.e., the shielding member B) is held inside the insulation housing bracket 2 of the USB Type-C electrical plug connector and located between signal contact sets (i.e., the first signal contact set 5 and the second signal contact set 8), so as to reduce electromagnetic interferences between a upper signal contact set and a lower signal contact set (i.e., the first signal contact set 5 and the second signal contact set 8) during high frequency transmission or high speed transmission.

When the USB Type-C electrical plug connector (i.e., the electrical plug connector 3000) transmits high frequency signals, the EMI shielding spring members (i.e., the first grounding member 4 and the second grounding member 7) shield the signal contact sets (i.e., the first signal contact set 5 and the second signal contact set 8) and the plug metal shell 1 of the USB Type-C electrical plug connector, and the shielding plate (i.e., the shielding member B) shields the signal contact sets of the USB Type-C electrical plug connector for preventing interferences between the signal contact sets of the USB Type-C electrical plug connector. In such a way, the EMI shielding spring members and the shielding plate reduce electromagnetic noises and electromagnetic interferences of the USB Type-C electrical plug connector during high frequency transmission, which improves performance of high frequency transmission between the USB Type-C electrical plug connector and the electrical receptacle connector and ensures normal operation of an electronic component (e.g., a wireless mouse, a Bluetooth device, or a hard disc) coupled to the USB Type-C electrical plug connector and an electronic component coupled to the USB Type-C electrical receptacle connector.

In this embodiment, the first connecting structures 4A, 4B are disposed on the first grounding member 4, and the second connecting structures 7A, 7B are disposed on the second grounding member 7. The shielding member B includes a shielding body B1, a resilient hook B2, and a grounding portion B3. The resilient hook B2 extends from the shielding body B1 for hooking the electrical receptacle connector 4000, as shown in FIG. 7. The grounding portion B3 extends from a side of the resilient hook B2 opposite to the resilient hook for coupling to a circuit board C, as shown in FIG. 5. Specifically, the first insulator 22 includes two first protruding pillars 221 and two first engaging holes 222 formed on the first insulator 22. The second insulator 23 includes two second protruding pillars 231 and two second engaging holes 232 formed on the second insulator 23. Two first through holes B4 and two second though holes B5 are formed on the shielding member B. The first protruding pillar 221 engages with the second engaging hole 232 via the first through hole B4, and the second protruding pillar 231 engages with the first engaging hole 222 via the second through hole B5. Accordingly, the second insulator 23 can be assembled on the first insulator 22 and clamp the shielding member B cooperatively with the first insulator 22. The numbers and the configurations of the first protruding pillar 221, the first engaging hole 222, the second protruding pillar 231, the second engaging hole 232, the first through hole B4 and the second through hole B5 are not limited to those illustrated in figures in this embodiment. In such a manner, when the electrical plug connector 3000 is mated with the electrical receptacle connector 4000, the resilient hook B2 of the shielding member B resiliently abuts against the electrical receptacle connector 4000, such that a shield is formed between the signal contact sets of the electrical plug connector 3000 and the electrical receptacle connector 4000, which prevents electromagnetic interferences and crosstalk.

Figure 8:
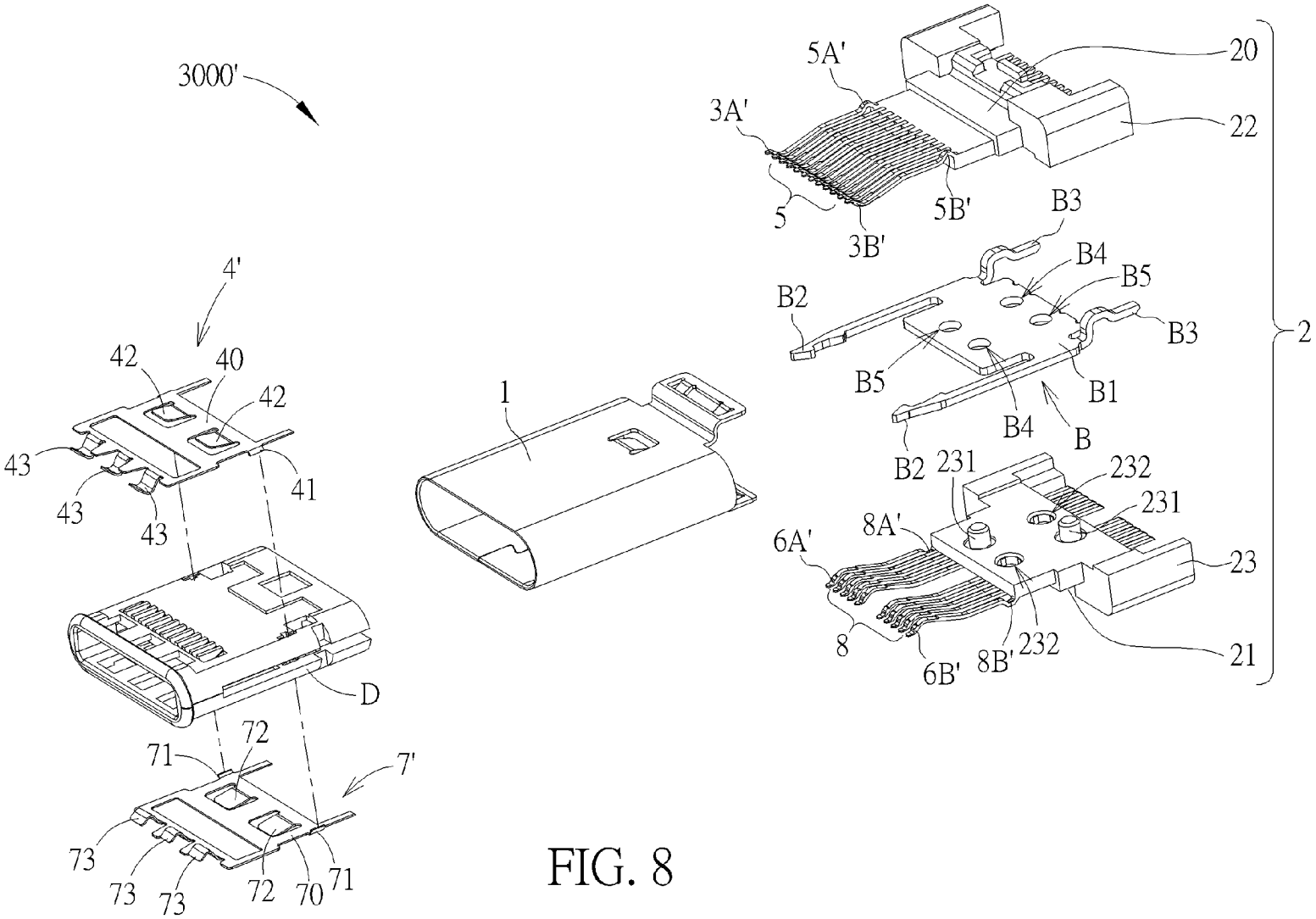
FIG. 8 is an exploded diagram of the electrical plug connector according to a second embodiment of the present invention.
Figure 9:
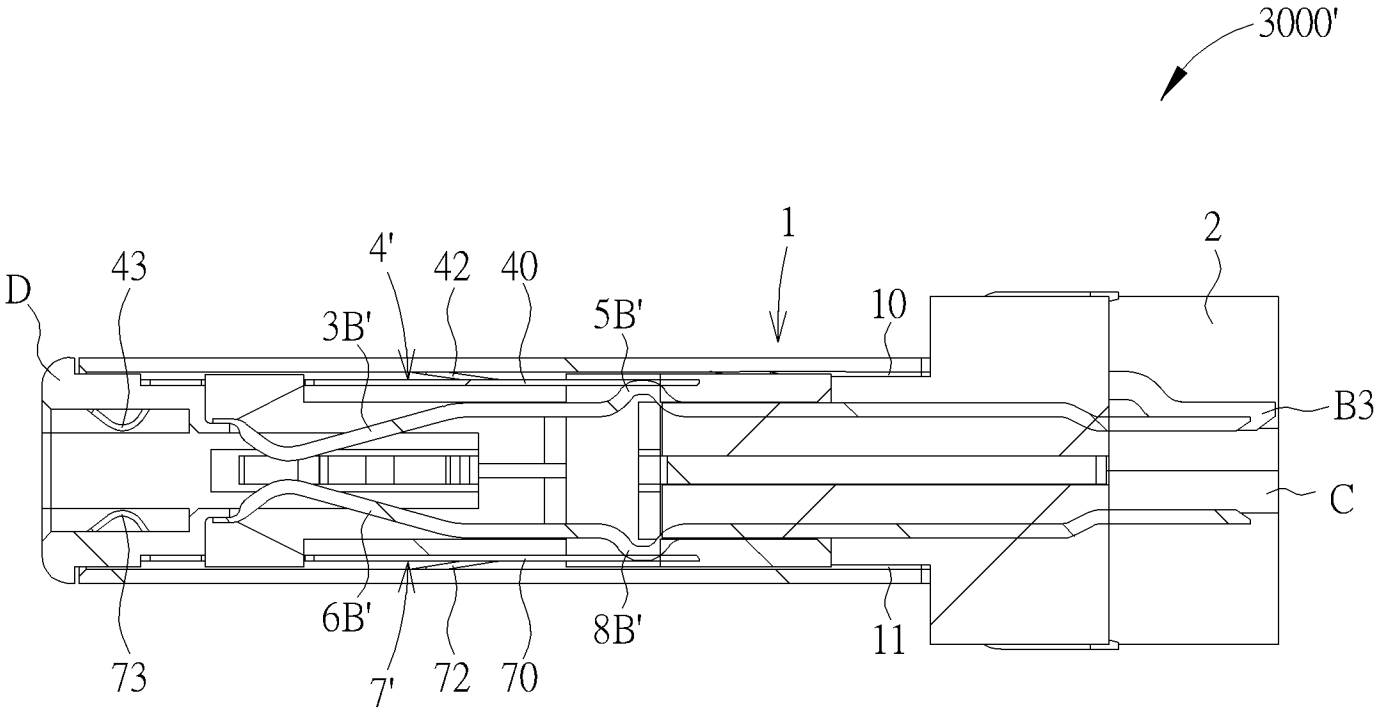
FIG. 9 is a sectional diagram of the electrical plug connector according to the second embodiment of the present invention.

Please refer to FIG. 8 and FIG. 9. FIG. 8 is an exploded diagram of the electrical plug connector 3000' according to a second embodiment of the present invention. FIG. 9 is a sectional diagram of the electrical plug connector 3000' according to the second embodiment of the present invention. The main difference between the electrical plug connector 3000' and the aforesaid electrical plug connector 3000 is that two first connecting structures 5A', 5B' and two second connecting structures 8A', 8B' of the electrical plug connector 3000' are contact bending structures. The first connecting structures 5A', 5B' are disposed on two first plug grounding contacts 3A', 3B' of the electrical plug connector 3000' and integrally formed with the first plug grounding contacts 3A', 3B'. The second connecting structures 8A', 8B' are disposed on two second plug grounding contacts 6A % 6B' and integrally formed with the second plug grounding contacts 6A % 6B'. Components with denoted in this embodiment identical to those in the aforesaid embodiment have identical structures and functions, and further description is omitted herein for simplicity.

Figure 10:
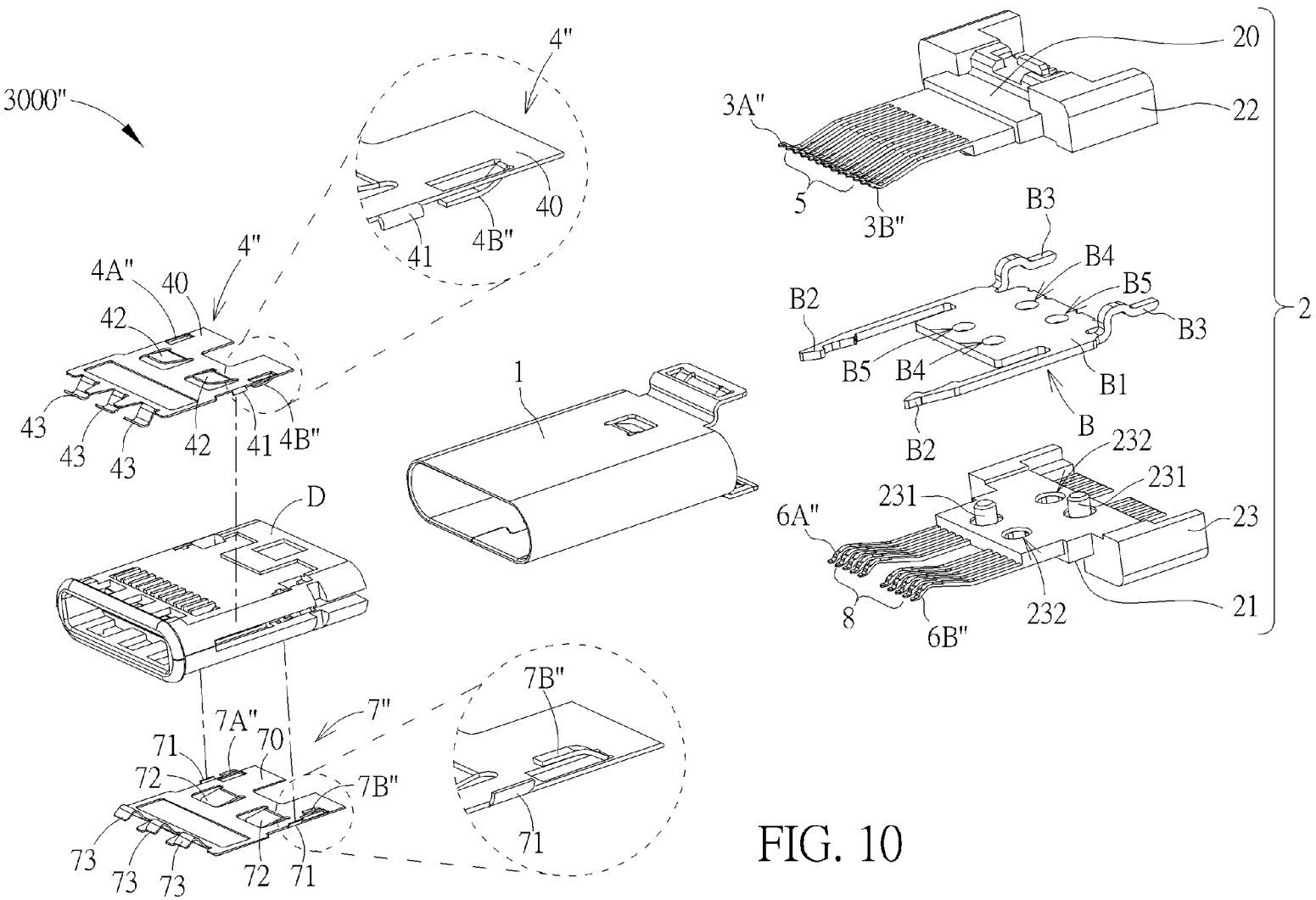
FIG. 10 is an exploded diagram of the electrical plug connector according to a third embodiment of the present invention.
Figure 11:
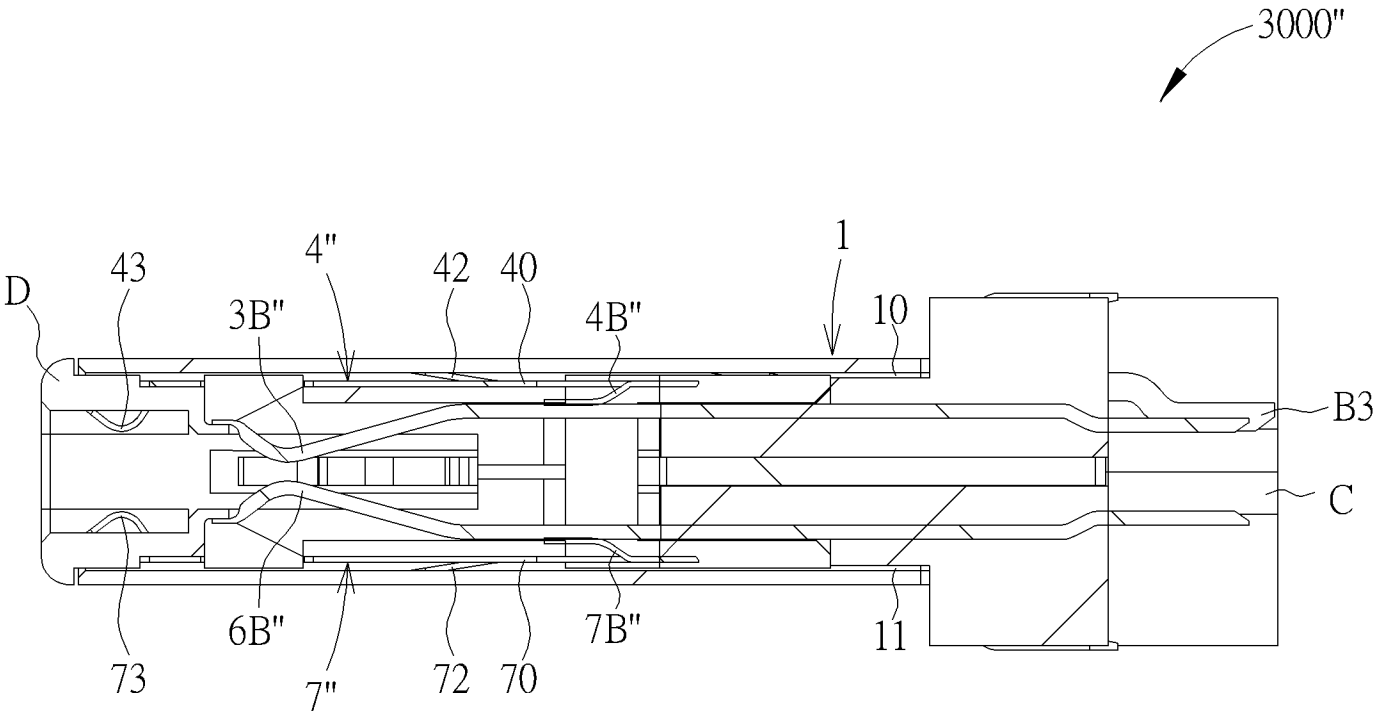
FIG. 11 is a sectional diagram of the electrical plug connector according to the third embodiment of the present invention.

Please refer to FIG. 10 and FIG. 11. FIG. 10 is an exploded diagram of the electrical plug connector 3000" according to a third embodiment of the present invention. FIG. 11 is a sectional diagram of the electrical plug connector 3000" according to the third embodiment of the present invention. The main difference between the electrical plug connector 3000" and the aforesaid electrical plug connector 3000 is that two first connecting structures 4A", 4B" and two second connecting structures 7A", 7B" of the electrical plug connector 3000' are spring arms. The first connecting structures 4A", 4B" are disposed on a first grounding member 4" of the electrical plug connector 3000" and integrally formed with the first grounding member 4". The second connecting structures 7A", 7B" are disposed on a second grounding member 7" of the electrical plug connector 3000" and integrally formed with the second grounding member 7". Components with denoted in this embodiment identical to those in the aforesaid embodiment have identical structures and functions, and further description is omitted herein for simplicity.

In contrast to the prior art, the present invention utilizes the first connecting structure and the first abutting portion for electrically connecting the plug metal shell, the first grounding member and the first plug grounding contact. The present invention further utilizes the second connecting structure and second abutting portion for electrically connecting the plug metal shell, the second grounding member, and the second plug grounding contact. In such a way, electromagnetic noises and electromagnetic interferences can be reduced when the electrical plug connector transmits high frequency signals or high speed signals, such that performance of high frequency transmission or high speed transmission of the electrical plug connector is improved. Furthermore, the present invention further utilizes the shielding member disposed between the first signal contact set and the second signal contact set for shielding the first signal contact set and the second signal contact set and for preventing interferences and crosstalk therebetween.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An electrical plug connector, comprising:

a plug metal shell with an accommodating space enclosed therein;

an insulation housing bracket having a first side, a first base portion and a first tongue portion, the first base portion having a first abutting surface, the first tongue portion protruding from the first abutting surface of the first base portion, a rear side of the plug metal shell abutting against the first abutting surface of the first base portion;

an insulation housing disposed inside the accommodating space, an internal socketing space being enclosed by the insulation housing, the first tongue portion being disposed in the internal socketing space;

a first plug grounding contact held inside the insulation housing bracket, and a portion of the first plug grounding contact being exposed on the first side of the insulation housing bracket;

a first grounding member disposed on the insulation housing, the first grounding member being located between the plug metal shell and the first plug grounding contact and spaced from the first side of the insulation housing bracket; and wherein a first connecting structure protrudes from one of the first plug grounding contact and the first grounding member and is disposed through the insulation housing for contacting with the other one of the first grounding member and the first grounding contact, so that the first grounding member mechanically contacts with and is electrically connected to the first plug grounding contact.

2. The electrical plug connector of claim 1, wherein the first connecting structure is a protrusion portion or a spring arm, and the first connecting structure and the first grounding member are integrally formed.

3. The electrical plug connector of claim 1, wherein the first connecting structure is a contact bending structure, and the first connecting structure and the first plug grounding contact are integrally formed.

4. The electrical plug connector of claim 1, wherein the insulation housing bracket has a second side opposite to the first side, and the electrical plug connector further comprises:

a second plug grounding contact held inside the insulation housing bracket and corresponding to the first plug grounding contact, a portion of the second plug grounding contact being exposed on the second side of the insulation housing bracket;

a second grounding member disposed on the insulation housing, the second grounding member being located between the plug metal shell and the second plug grounding contact and spaced from the second side of the insulation housing bracket; and a second connecting structure protruding from one of the second plug grounding contact and the second grounding member and disposed through the insulation housing for contacting with the other one of the second grounding member and the second grounding contact, so that the second grounding member mechanically contacts with and is electrically connected to the second plug grounding contact.

5. The electrical plug connector of claim 4, wherein the first grounding member further comprises:

a first grounding body installed on the insulation housing; and a first abutting portion protruding from the first grounding body, the first abutting portion abutting against the plug metal shell, such that the first grounding body is electrically connected to the plug metal shell.

6. The electrical plug connector of claim 5, wherein the second grounding member further comprises:

a second grounding body installed on a side of the insulation housing and opposite to the first grounding body; and a second abutting portion protruding from the second grounding body, the second abutting portion abutting against the plug metal shell, such that the second grounding body is electrically connected to the plug metal shell.

7. The electrical plug connector of claim 6, wherein the first grounding member further comprises a first resilient portion extending from an end of the first grounding body and stretching into the internal socketing space, the second grounding member further comprises a second resilient portion extending from an end of the second grounding body and stretching into the internal socketing space.

8. The electrical plug connector of claim 6, wherein the first grounding member further comprises a first mounting leg protruding from the first grounding body and embedding into the insulation housing, the second grounding member further comprises a second mounting leg protruding from the second grounding body and embedding into the insulation housing.

9. The electrical plug connector of claim 4, further comprising:

a first signal contact set arranged alongside the first plug grounding contact;

a second signal contact set arranged alongside the second plug grounding contact; and a shielding member disposed between the first signal contact set and the second signal contact set, the shielding member being for shielding the first signal contact set and the second signal contact set.

10. The electrical plug connector of claim 9, wherein the insulation housing bracket comprises a first insulator and a second insulator, the second insulator is detachably assembled on the first insulator, and the first insulator and the second insulator clamp the shielding member cooperatively.

11. The electrical plug connector of claim 10, wherein the first insulator comprises a first protruding pillar and a first engaging hole formed thereon, the second insulator comprises a second protruding pillar and a second engaging hole formed thereon, a first through hole and a second through hole are formed on the shielding member, the first protruding pillar engages with the second engaging hole via the first through hole, and the second protruding pillar engages with the first engaging hole via the second through hole.

12. The electrical plug connector of claim 9, wherein the shielding member comprises:

a shielding body;

a resilient hook extending from the shielding body and being for hooking an electrical receptacle connector; and a grounding portion extending from a side of the shielding body and being opposite to the resilient hook, the grounding portion being coupled to a circuit board.

13. The electrical plug connector of claim 1, wherein the base portion comprises a first base portion and a second base portion, the tongue portion comprises a first tongue portion and a second tongue portion, and the abutting surface comprises a first abutting surface and a second abutting surface.

14. An electrical plug connector, comprising:

a plug metal shell, an accommodating space being enclosed by the plug metal shell;

a first terminal module, comprising:

a first insulator;

a first signal contact set held inside the first insulator; and two first plug grounding contacts held inside the first insulator and arranged alongside the first signal contact set, the two first plug grounding contacts being disposed on two opposite sides of the first signal contact set respectively;

a second terminal module, comprising:

a second insulator assembled with the first insulator to form an insulation housing bracket;

a second signal contact set held inside the second insulator; and two second plug grounding contacts held inside the second insulator and arranged alongside the second signal contact set, the two second plug grounding contacts being disposed on two opposite sides of the second signal contact set respectively;

an insulation housing disposed inside the accommodating space, an internal socketing space being enclosed by the insulation housing, and the internal socketing space being for accommodating the two first plug grounding contacts and the two second plug grounding contacts; and a first grounding member disposed between the plug metal shell and the two first plug grounding contacts, and spaced from a first side of the insulation housing bracket, the first grounding member being mechanically contacting with the two first plug grounding contacts, such that the first grounding member is electrically connected to the two first plug grounding contacts.

15. The electrical plug connector of the claim 14, wherein each of the first signal contact set and the second signal contact set comprises at least two pairs of differential signal contacts, the differential signal contacts of the first signal contact set is symmetric to the differential signal contacts of the second signal contact set by rotational of 180 degrees along a front-back direction of the electrical plug connector.

16. The electrical plug connector of the claim 14, wherein the first grounding member comprises a first connecting structure protruding from the first grounding member and contacting with the two first plug grounding contacts, such that the first grounding member is electrically connected to the two first plug grounding contacts, wherein the first connecting structure is a protrusion portion or a spring arm, and the first connecting structure and the first grounding member are integrally formed.

17. The electrical plug connector of the claim 14, wherein each of the two first plug grounding contacts comprises a first connecting structure contacting with the first grounding member, such the first grounding member is electrically connected to the two first plug grounding contacts, wherein the first connecting structure is a contact bending structure, and the first connecting structure and the two first plug grounding contacts are integrally formed.

18. The electrical plug connector of claim 14, wherein the first grounding member further comprises:

a first grounding body installed on the insulation housing; and a first abutting portion protruding from the first grounding body, the first abutting portion abutting against the plug metal shell, such that the first grounding body is electrically connected to the plug metal shell.

19. The electrical plug connector of claim 14, wherein the first grounding member further comprises a first resilient portion extending from an end of the first grounding body and stretching into the internal socketing space.

20. The electrical plug connector of claim 14, wherein the first grounding member further comprises a first mounting leg protruding from the first grounding body and embedding into the insulation housing.

21. The electrical plug connector of claim 14, further comprising a second grounding member installed on the insulation housing and disposed between the plug metal shell and the two second plug grounding contacts, and the second grounding member mechanically contacting with the two second plug grounding contacts, such that the second grounding member is electrically connected to the two second plug grounding contacts.

22. The electrical plug connector of claim 21, wherein the first grounding member comprises a first connecting structure protruding from the first grounding member and contacting with the two first plug grounding contacts, the second grounding member comprises a second connecting structure protruding from the second grounding member and contacting with the two second plug grounding contacts, such that the second grounding member is electrically connected to the two second plug grounding contacts, wherein the second connecting structure is a protrusion portion or a spring arm, and the first connecting structure and the first grounding member are integrally formed.

23. The electrical plug connector of claim 21, wherein each of the two first plug grounding contacts comprises a first connecting structure contacting with the first grounding member, each of the two second plug grounding contacts comprises a second connecting structure contacting with the second grounding member, such the second grounding member is electrically connected to the two second plug grounding contacts, wherein the second connecting structure is a contact bending structure, and the second connecting structure and the two second plug grounding contacts are integrally formed.

24. An electrical plug connector, comprising:

a plug metal shell with an accommodating space enclosed therein;

an insulation housing bracket having a side, a base portion and a tongue portion, the base portion having an abutting surface, the tongue portion protruding from the abutting surface of the base portion, a rear side of the plug metal shell abutting against the abutting surface of the base portion;

an insulation housing disposed inside the accommodating space, an internal socketing space being enclosed by the insulation housing, the tongue portion being disposed in the internal socketing space;

a plug grounding contact held inside the insulation housing bracket, and a portion of the plug grounding contact being exposed on the side of the insulation housing bracket; and a grounding member disposed between the plug metal shell and the plug grounding contact, the grounding member being spaced from the side of the insulation housing bracket, the grounding member mechanically contacting with the plug grounding contact, such that the grounding member is electrically connected to the plug grounding contact.

* * * * *